US011686503B2

(12) United States Patent
Lin

(10) Patent No.: US 11,686,503 B2
(45) Date of Patent: Jun. 27, 2023

(54) SMART ELECTRIC HEATING DEVICE

(71) Applicant: Yu-Chen Lin, Tainan (TW)

(72) Inventor: Yu-Chen Lin, Tainan (TW)

( * ) Notice: Subject to any disclaimer, the term of this patent is extended or adjusted under 35 U.S.C. 154(b) by 205 days.

(21) Appl. No.: 17/329,550

(22) Filed: May 25, 2021

(65) Prior Publication Data

US 2022/0252302 A1 Aug. 11, 2022

(30) Foreign Application Priority Data

Feb. 8, 2021 (TW) ..... 110104768

(51) Int. Cl.

| | |
|---|---|
| ***F24H 9/20*** | (2022.01) |
| ***F24H 9/13*** | (2022.01) |
| ***F24H 1/20*** | (2022.01) |
| ***H05B 1/02*** | (2006.01) |

(52) U.S. Cl.

CPC ..... *F24H 9/2021* (2013.01); *F24H 1/201* (2013.01); *F24H 9/136* (2022.01); *H05B 1/0297* (2013.01)

(58) Field of Classification Search

CPC ..... F24H 9/126; F24H 9/2021

See application file for complete search history.

(56) References Cited

U.S. PATENT DOCUMENTS

| | | | | |
|---|---|---|---|---|
| 4,638,944 | A * | 1/1987 | Kujawa | F24D 17/00 122/13.3 |
| 2007/0108304 | A1* | 5/2007 | Seki | F24D 17/00 237/12 |
| 2008/0197205 | A1* | 8/2008 | Ene | F28D 21/0007 237/19 |
| 2008/0216770 | A1* | 9/2008 | Humphrey | F24H 1/145 122/13.3 |
| 2012/0060827 | A1* | 3/2012 | Roetker | F24D 19/1057 126/714 |
| 2012/0325337 | A1* | 12/2012 | Nakagawa | F24H 1/122 137/341 |
| 2013/0308930 | A1* | 11/2013 | Lin | F24H 9/1818 392/490 |
| 2019/0170398 | A1* | 6/2019 | Chaudhry | F24H 9/13 |

* cited by examiner

*Primary Examiner* — Nathaniel Herzfeld
(74) *Attorney, Agent, or Firm* — Rosenberg, Klein & Lee

(57) ABSTRACT

A smart electric heating device comprises a storage unit, a first heating unit, a second heating unit, a control unit and a first temperature sensing unit. With the first temperature sensing unit to obtain an ambient temperature, the control unit compares the ambient temperature with a maximum increased temperature and a set temperature for controlling the first heating unit and the second heating unit to actuate. In this way, each user can use hot water of sufficient temperature better.

10 Claims, 10 Drawing Sheets

SMART ELECTRIC HEATING DEVICE

FIELD OF THE INVENTION

The present invention relates to a smart electric heating device.

BACKGROUND OF THE INVENTION

Electric heating devices, such as water heaters, are generally classified into two categories: thermal storage water heaters, as disclosed in Taiwan Utility Model Publication No. M281147 titled "structural improvement of storage-type electric water heater" and instantaneous water heaters, as disclosed in Taiwan Patent Publication No. 1471510 titled "electric heating device".

Generally, a thermal storage water heater or an instantaneous water heater is selectively installed. However, in summer, the thermal storage water heater consumes excess energy and requires a long wait. In winter, the power of the instantaneous water heater is limited by the wiring of a building, and the water temperature to be increased by heating is limited. Especially in cold areas, it is difficult to take a hot bath through the heating of the instantaneous water heater.

SUMMARY OF THE INVENTION

The primary object of the present invention is to provide a smart electric heating device, comprising: a storage unit, stored with water; a first heating unit, disposed in the storage unit; a liquid pipe, adjacent to the storage unit, the liquid pipe having an inlet communicating with the storage unit and an outlet opposite to the inlet; a second heating unit, adjacent to the storage unit and corresponding to the liquid pipe, the second heating unit being configured to heat water in the liquid pipe with a maximum increased temperature; a control unit, being in signal connection with the first heating unit and the second heating unit; and a first temperature sensing unit, being in signal connection with the control unit, the first temperature sensing unit being disposed outside the storage unit, the first temperature sensing unit being configured to obtain an ambient temperature outside the storage unit; wherein after the first temperature sensing unit obtains the ambient temperature, the control unit compares the ambient temperature with the maximum increased temperature and a set temperature; wherein when a difference value between the set temperature and the ambient temperature is greater than the maximum increased temperature, the control unit controls the first heating unit to actuate for heating the water in the storage unit and selectively controls the second heating unit to actuate for heating the water in the liquid pipe, so that an effluent water temperature of the water flowing from the outlet reaches the set temperature; wherein when the difference value between the set temperature and the ambient temperature is not greater than the maximum increased temperature, the control unit controls the first heating unit not to actuate and selectively controls the second heating unit to actuate for heating the water in the liquid pipe, so that the effluent water temperature of the water flowing from the outlet reaches the set temperature.

Preferably, the smart electric heating device further comprises a flow sensing unit adjacent to the inlet and corresponding to the liquid pipe. The flow sensing unit is in signal connection with the control unit. When the water in the storage unit flows into the liquid pipe through the inlet and the flow sensing unit obtains that a flow rate change of the water in the liquid pipe is not zero, the control unit controls the first heating unit not to actuate and the second heating unit to actuate.

Preferably, the smart electric heating device further comprises a plurality of heating sections between the inlet and the outlet. The second heating unit is a plurality of electric heating rods accommodated in the respective heating sections. The control unit includes a plurality of control members electrically connected to the respective electric heating rods.

Alternatively, the smart electric heating device further comprises a second temperature sensing unit and a flow sensing unit adjacent to the inlet and corresponding to the liquid pipe. The second temperature sensing unit and the flow sensing unit are in signal connection with the control unit. When the water in the storage unit flows into the liquid pipe through the inlet, the second temperature sensing unit obtains an influent water temperature of the water flowing into the liquid pipe, the flow sensing unit obtains a flow rate change of the water in the liquid pipe, and the control unit controls a heating power of each of the electric heating rods through the respective control members according to a difference value between the set temperature and the influent water temperature as well as the flow rate change.

Preferably, the control members are thyristors. When the control unit controls the heating power of each of the electric heating rods through the respective control members, the heating power of each of the electric heating rods is between 0% and 100% of a maximum heating power. When the heating power of all the electric heating rods is 100% of the maximum heating power, it corresponds to the maximum increased temperature.

Preferably, the smart electric heating device further comprises a third temperature sensing unit disposed in the storage unit and configured to obtain a storage water temperature in the storage unit. The third temperature sensing unit is in signal connection with the control unit. When a difference value between the set temperature and the storage water temperature is not greater than the maximum increased temperature, the control unit controls the first heating unit not to actuate.

Preferably, the smart electric heating device further comprises a water level detection unit disposed in the storage unit and a water replenishment unit communicating with the storage unit. The water level detection unit and the water replenishment unit are in signal connection with the control unit. When the water level detection unit detects that a water level in the storage unit is lower than a threshold, the control unit controls the water replenishment unit to replenish water to the storage unit.

Preferably, the liquid pipe is disposed under the storage unit, and the inlet is lower than the storage unit.

Preferably, a sum of the set temperature and the ambient temperature is a fixed value.

Preferably, the first heating unit is an electric heating rod, and the control unit includes a relay electrically connected to the electric heating rod.

According to the above technical features, the following effects can be achieved:

1. The control unit controls the first heating unit and the second heating unit to be actuated or not according to the relationship between the ambient temperature, the set temperature and the maximum increased temperature. This allows users to use hot water of sufficient temperature better in different seasons and regions.

2. When the water in the liquid pipe flows, the control unit will control the first heating unit not to actuate and the second heating unit to actuate. This prevents the first heating unit and the second heating unit from actuating at the same time to cause the current to exceed the current load of a building, resulting in that the power goes off suddenly.

3. When the water level is lower than a threshold, the control unit will control the water replenishment unit to replenish water to the storage unit.

4. The inlet is lower than the storage unit, there is no need to provide a water pumping apparatus for pumping water into the liquid pipe, thereby saving energy.

5. With the third temperature sensing unit, when not in use, the control unit will appropriately control the first heating unit not to actuate, so as to prevent the first heating unit from actuating for a long time.

DESCRIPTION OF THE PREFERRED EMBODIMENTS

Embodiments of the present invention will now be described, by way of example only, with reference to the accompanying drawings.

Figure 1:
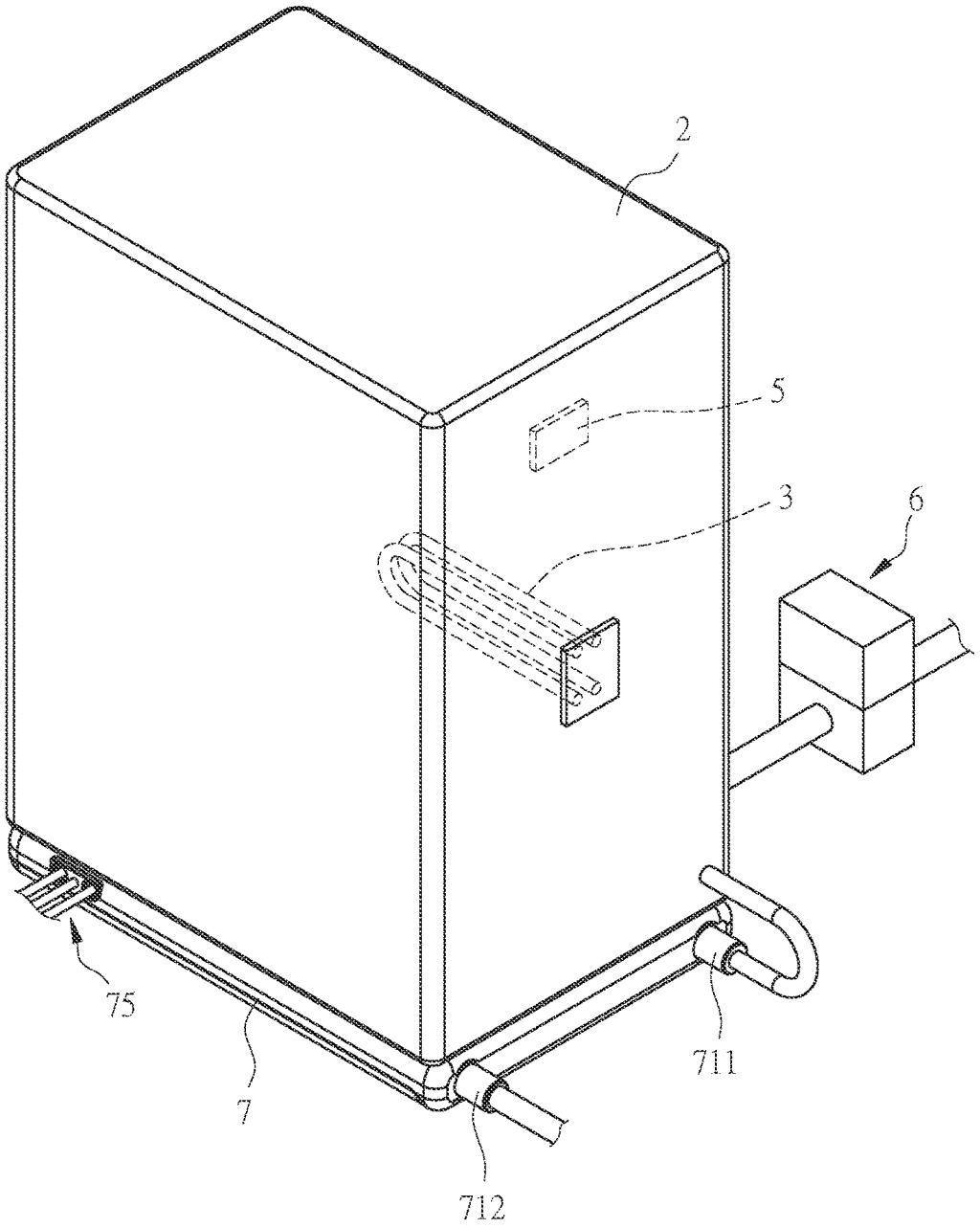
FIG. 1 is a perspective view according to a preferred embodiment of the present invention.
Figure 2:
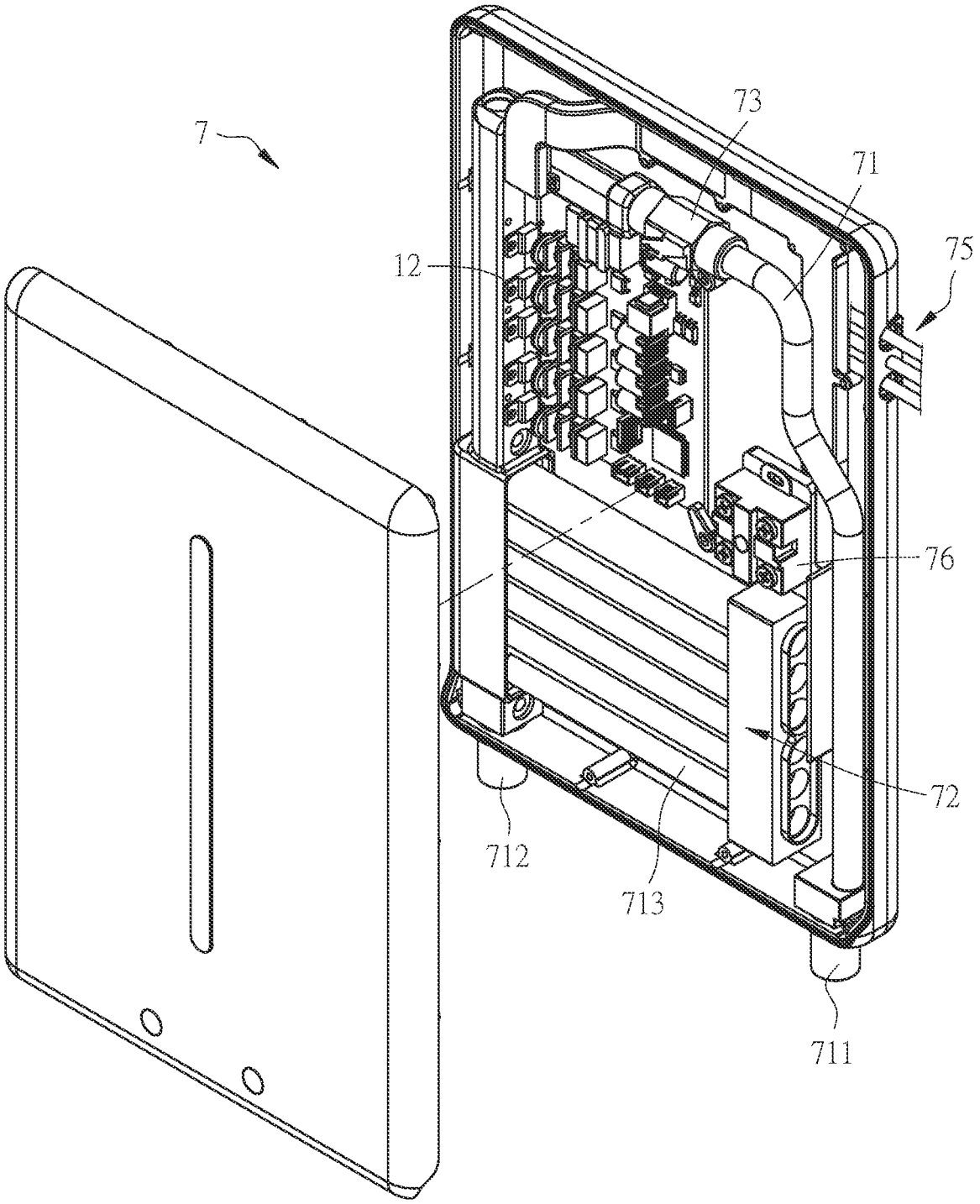
FIG. 2 is a partially exploded view of the control box according to the preferred embodiment of the present invention.
Figure 3:
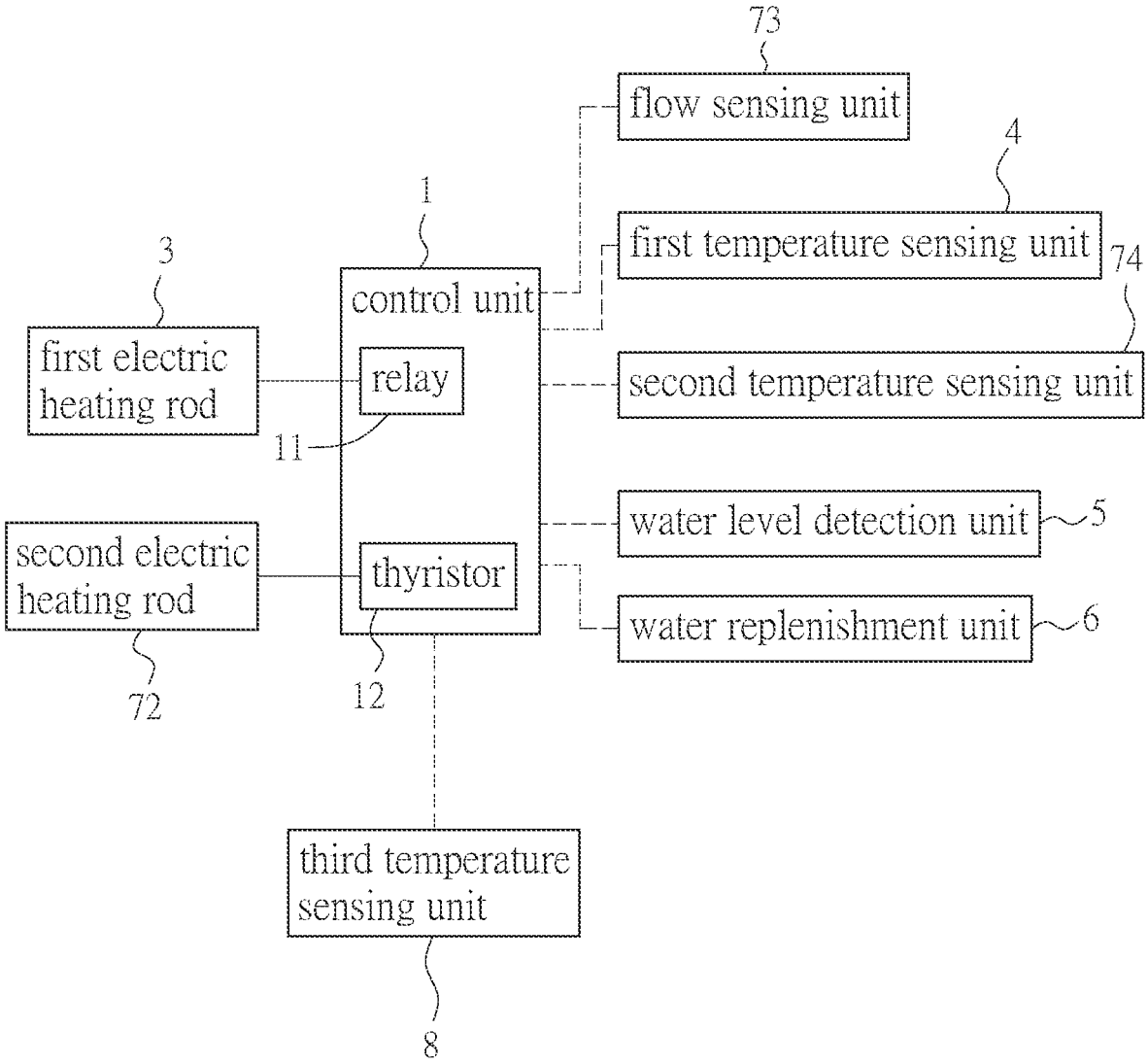
FIG. 3 is a block diagram of the system according to the preferred embodiment of the present invention.

As shown in FIG. 1 through FIG. 3, the present invention discloses a smart electric heating device, comprising a control unit 1, a storage unit 2, a first heating unit, a first temperature sensing unit 4, a water level detection unit 5, and a water replenishment unit 6. A control box 7 is disposed below the storage unit 2. The control box 7 has a liquid pipe 71, a second heating unit, a flow sensing unit 73, and a second temperature sensing unit 74. The control box 7 is provided with a power terminal 75 connected to an external power source (not shown). A protection unit 76 is electrically connected to the power terminal 75 to cut off power when the control box 7 is abnormal.

Figure 5:
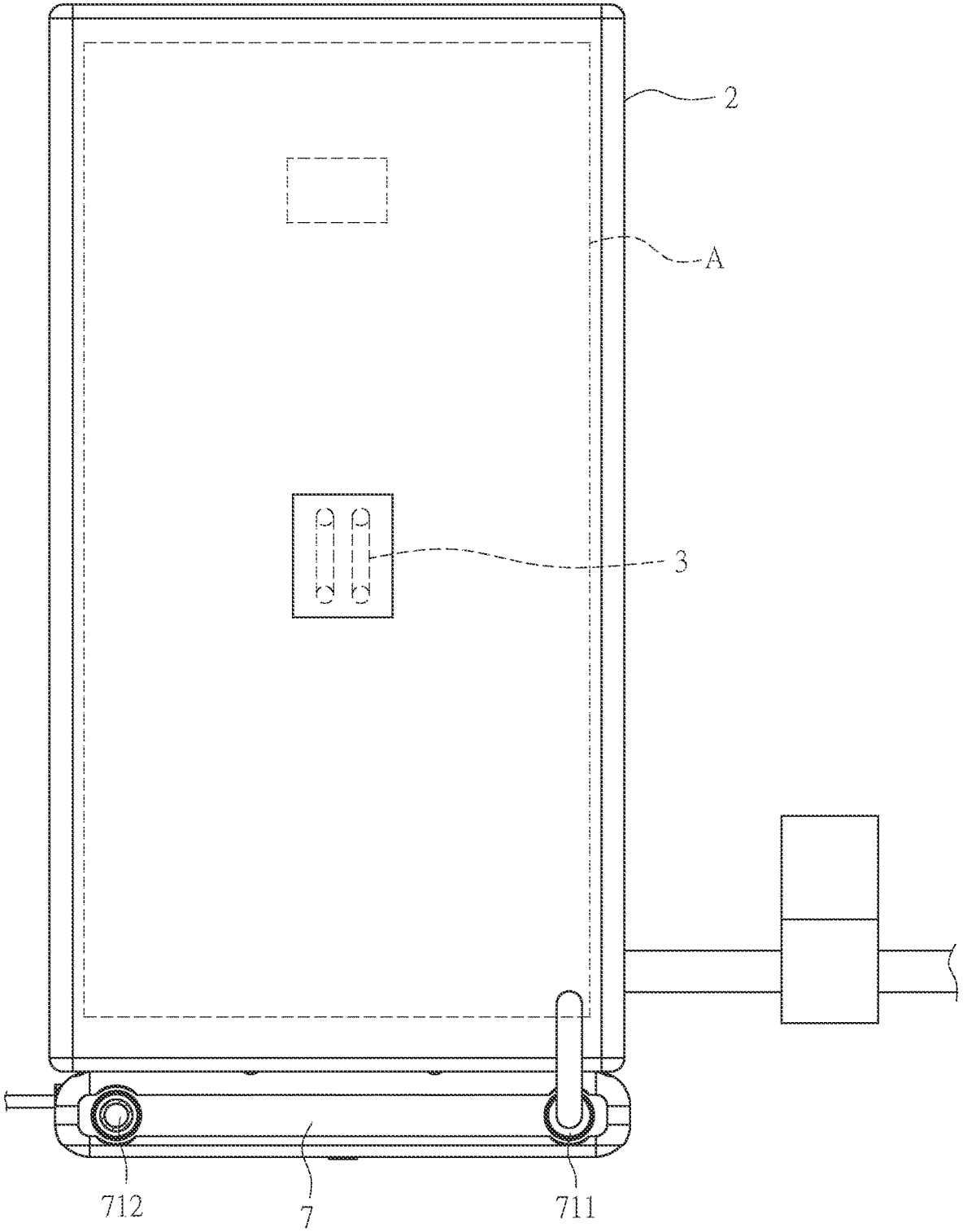
FIG. 5 is a first schematic view according to the preferred embodiment of the present invention, illustrating that the storage unit is filled with use water.

The storage unit 2 is stored with a use water A (as shown in FIG. 5), such as a water tank of a general water heater. The storage unit 2 has a third temperature sensing unit 8 to obtain a storage water temperature of the use water A in the storage unit 2.

The liquid pipe 71 has an inlet 711 communicating with the storage unit 2 and an outlet 712 opposite to the inlet 711. The inlet 711 is lower than the storage unit 2. The outlet 712 is in communication with a water use apparatus, such as a faucet. A plurality of heating sections 713 are provided between the inlet 711 and the outlet 712. The heating sections 713 are parallel to each other.

The first heating unit is a first electric heating rod 3, and is disposed in the storage unit 2.

The second heating unit is a plurality of second electric heating rods 72, and is disposed under the storage unit 2. The second electric heating rods 72 are accommodated in the respective heating sections 713.

The control unit 1 is in signal connection with the first electric heating rod 3, the second electric heating rods 72, the flow sensing unit 73, the first temperature sensing unit 4, the second temperature sensing unit 74, the water level detection Unit 5, the water replenishment unit 6, and the third temperature sensing unit 8. The control unit 1 includes a relay 11 electrically connected to the first electric heating rod 3 and a plurality of thyristors 12 electrically connected to the respective second electric heating rods 72.

The second electric heating rods 72 are configured to heat the use water Ain the liquid pipe 71. The heating power of each second electric heating rod 72 is between 0% and 100% of a maximum heating power. When the heating power of all the second electric heating rods 72 is 100% of the maximum heating power, it corresponds to a maximum increased temperature of the use water A, such as 20 degrees Celsius.

The first temperature sensing unit 4 is disposed below the outside of the storage unit 2. The flow sensing unit 73 and the second temperature sensing unit 74 are disposed between the inlet 711 and the heating sections 713 and correspond to the liquid pipe 71. The flow sensing unit 73 is closer to the inlet 711 than the second temperature sensing unit 74.

The water level detection unit 5 is disposed in the storage unit 2. The water replenishment unit 6 is in communication with the storage unit 2, such as a water solenoid valve.

Figure 4:
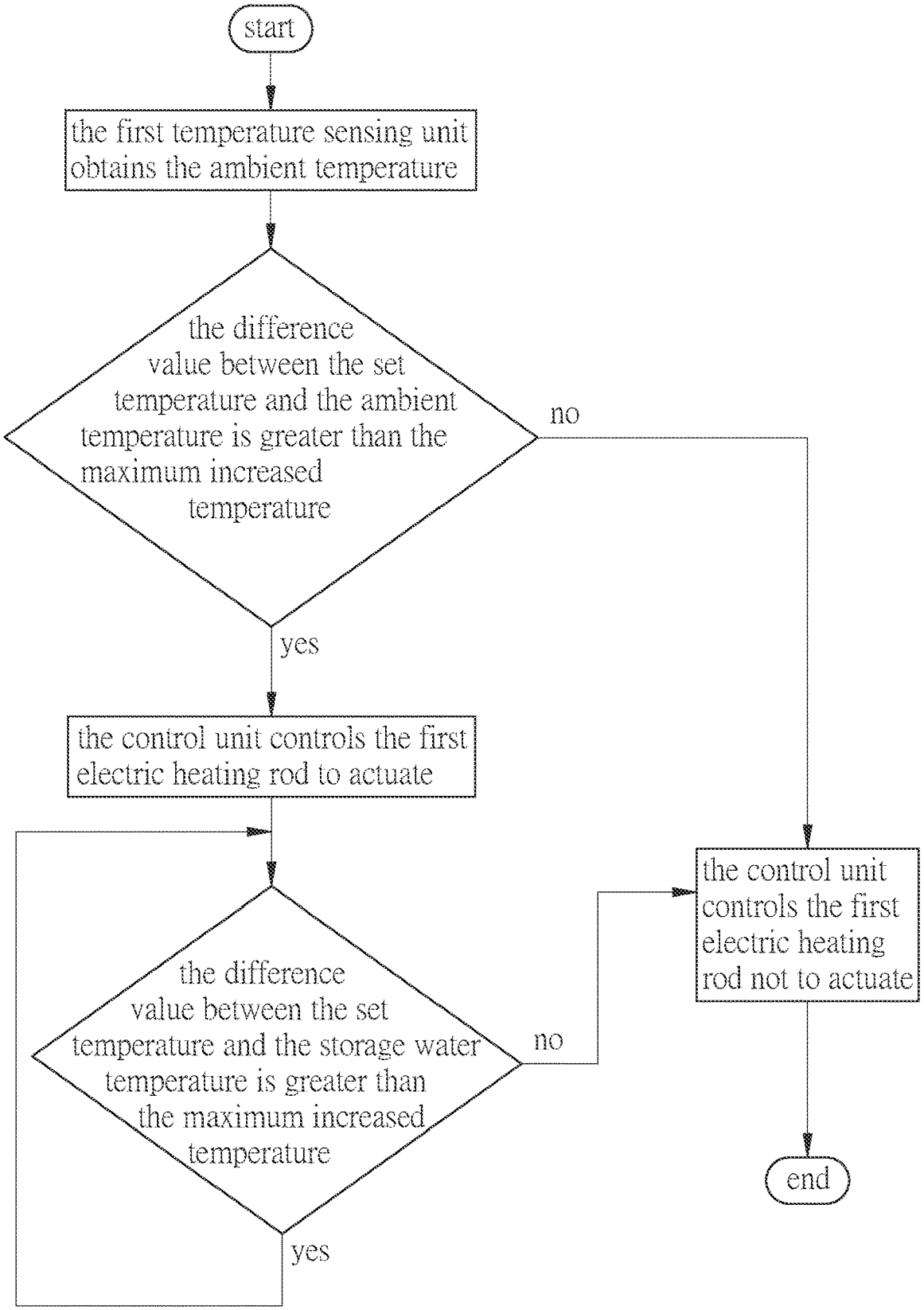
FIG. 4 is a first flow diagram according to the preferred embodiment of the present invention, illustrating that the first electric heating rod is controlled.

Please refer to FIGS. 3 to 5. When in use, the first temperature sensing unit 4 obtains an ambient temperature outside the storage unit 2 and sends it to the control unit 1. The control unit 1 compares the ambient temperature with the maximum increased temperature and a set temperature. If the difference value between the set temperature and the ambient temperature is greater than the maximum increased temperature, the control unit 1 controls the first electric heating rod 3 to actuate. The sum of the set temperature and the ambient temperature may be a fixed value, so that the control unit 1 can automatically adjust the set temperature according to different seasons.

When the sum of the set temperature and the ambient temperature is 65 degrees Celsius, the ambient temperature is 10 degrees Celsius, and the set temperature is 55 degrees Celsius. Because the difference value between the set temperature and the ambient temperature is 45 degrees Celsius, which is greater than the maximum increased temperature of 20 degrees Celsius, the control unit 1 controls the first electric heating rod 3 to actuate for heating the use water in the storage unit 2.

After the first electric heating rod 3 is actuated to heat the use water A, the third temperature sensing unit 8 can continuously obtain the storage water temperature. When the difference value between the set temperature and the storage water temperature is not greater than the maximum increased temperature, the control unit 1 controls the first electric heating rod 3 not to actuate. Even if the user has not turned on the water use apparatus, the control unit 1 still appropriately controls the first electric heating rod 3 not to actuate. If the storage water temperature of the use water Ain the storage unit 2 drops again, the control unit 1 can control the first electric heating rod 3 to actuate again, but this scenario is not shown in the figures.

When the sum of the set temperature and the ambient temperature is 65 degrees Celsius, the ambient temperature is 25 degrees Celsius, and the set temperature is 40 degrees Celsius. Because the difference value between the set temperature and the ambient temperature is 15 degrees Celsius, which is not greater than the maximum increased temperature of 20 degrees Celsius, the control unit 1 controls the first electric heating rod 3 not to actuate.

Figure 6:
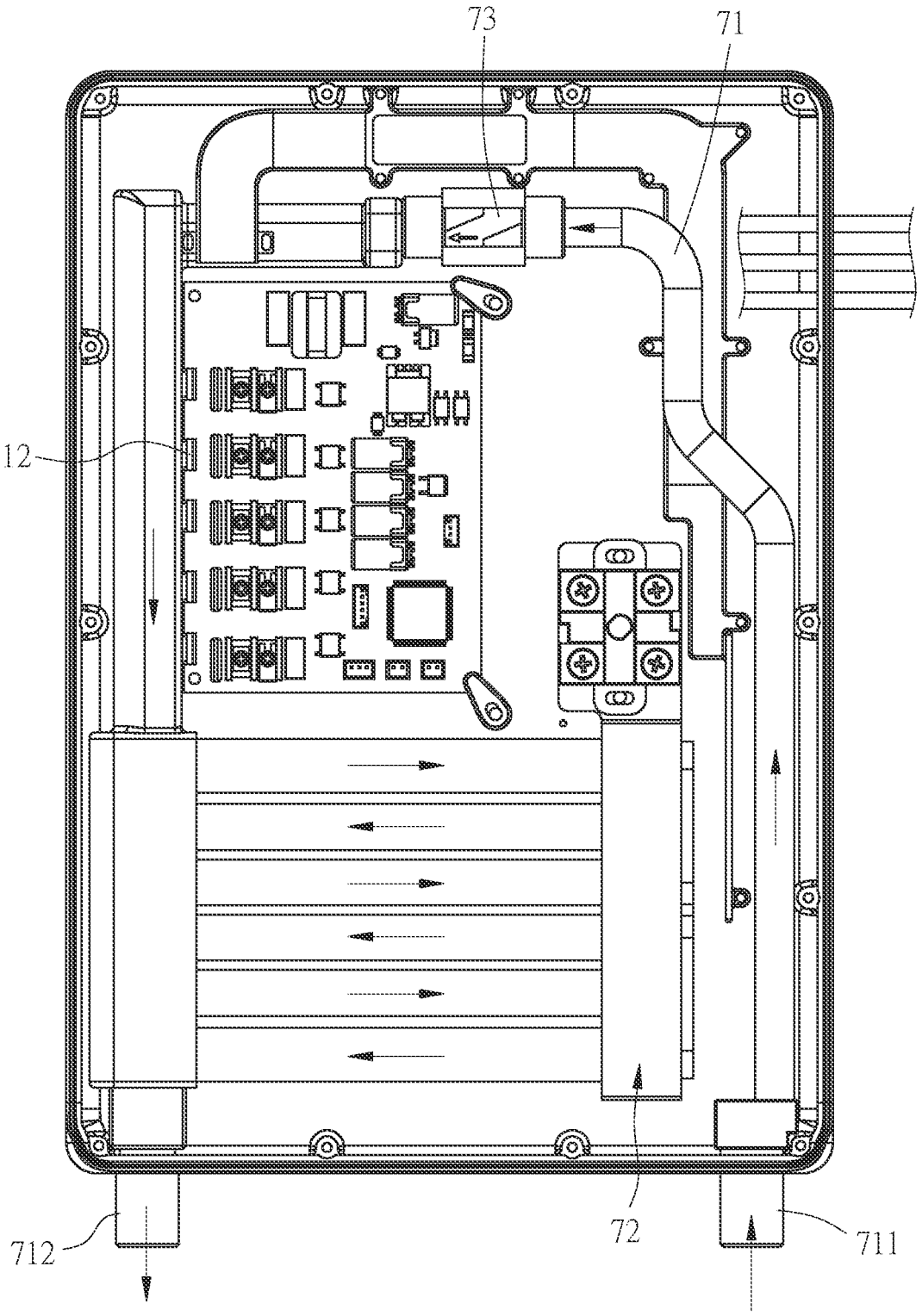
FIG. 6 is a second schematic view according to the preferred embodiment of the present invention, illustrating that the flow of the use water.
Figure 7:
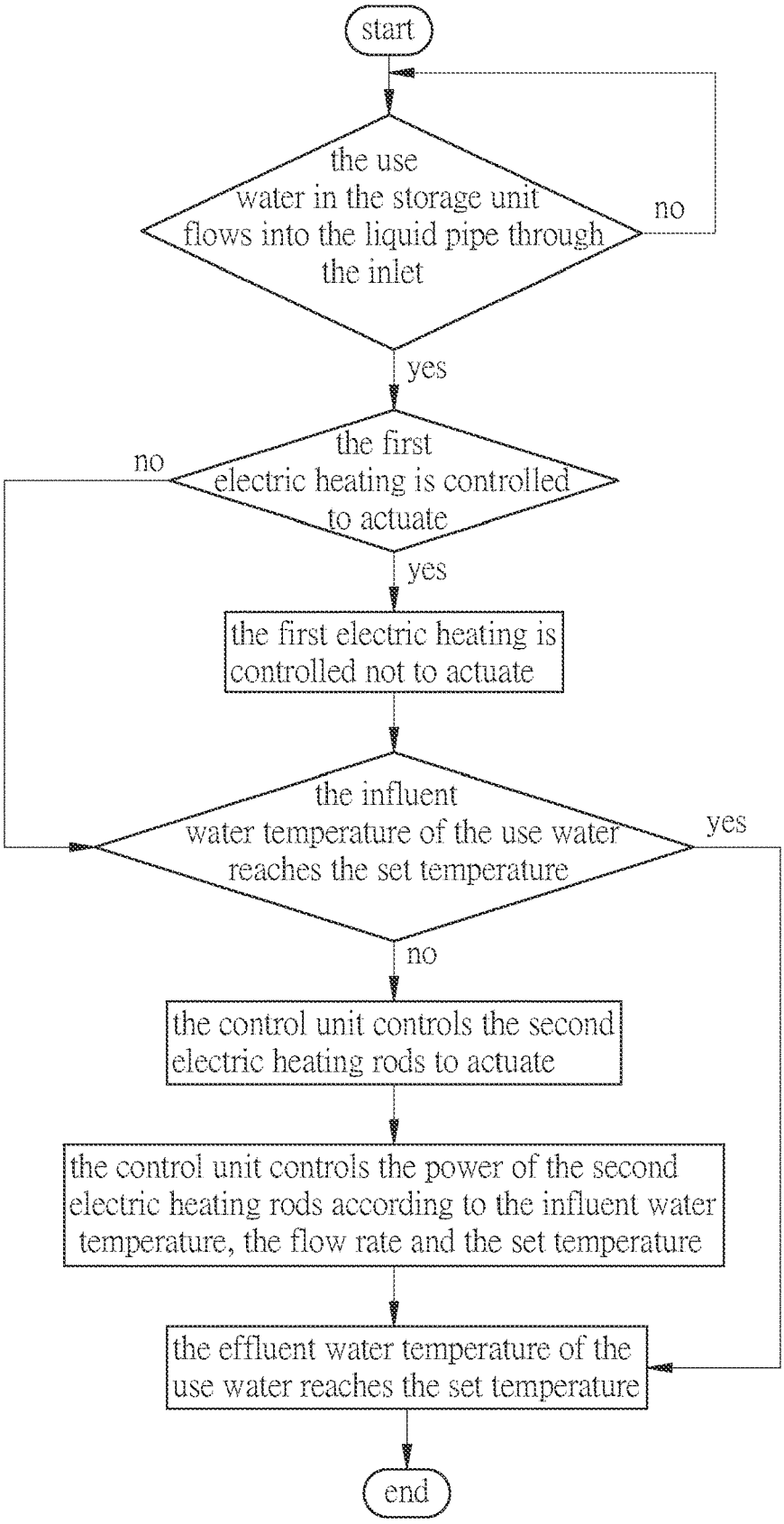
FIG. 7 is a second flow diagram according to the preferred embodiment of the present invention, illustrating that the second electric heating rods are controlled.

Please refer to FIGS. 5-7 in cooperation with FIG. 3. When the user turns on the water use apparatus, the use water A in the storage unit 2 flows into the liquid pipe 71 through the inlet 711.

The control unit 1 controls the first electric heating rod 3 not to actuate when the flow sensing unit 73 obtains that a flow rate change of the water in the liquid pipe 71 is not zero.

When the use water A continues to flow through the second temperature sensing unit 74, the second temperature sensing unit 74 obtains an influent water temperature of the use water A and sends it to the control unit 1. Then, the control unit 1 controls the actuation and heating power of each of the second electric heating rods 72 through the respective thyristors 12 according to the difference value between the set temperature and the influent water temperature as well as the flow rate change, thereby reducing unnecessary energy consumption. Besides, the use water A can be accurately heated to the set temperature.

When the set temperature is equal to the influent water temperature, or even when the influent water temperature is greater than the set temperature, the second electric heating rods 72 are not actuated. Then, when the use water A continues to flow to the outlet 712, an effluent water temperature will reach the set temperature.

Figure 8:
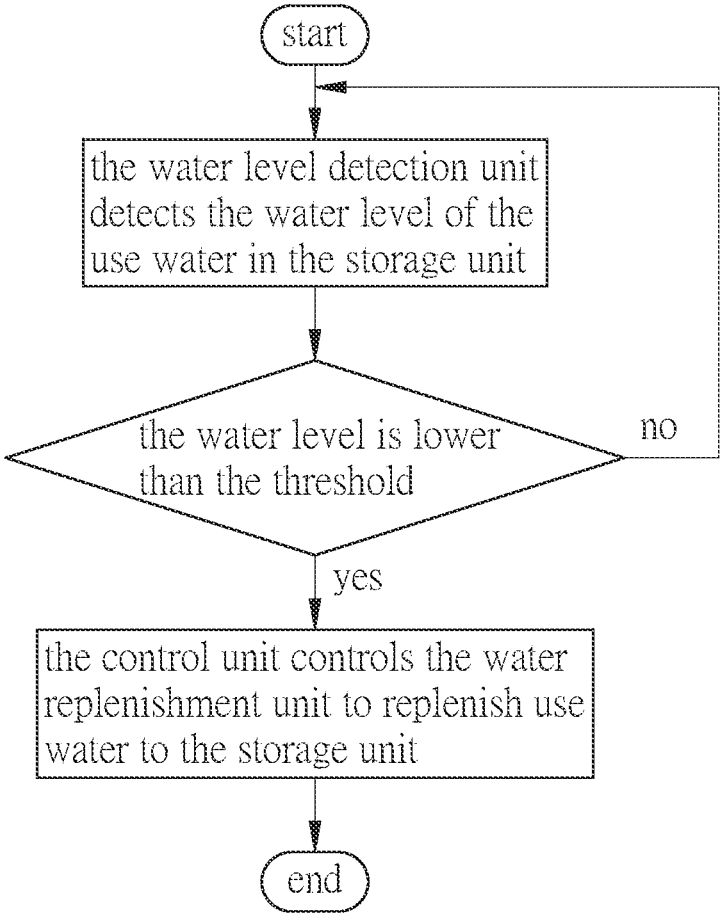
FIG. 8 is a third flow diagram according to the preferred embodiment of the present invention, illustrating that the use water is replenished.
Figure 9:
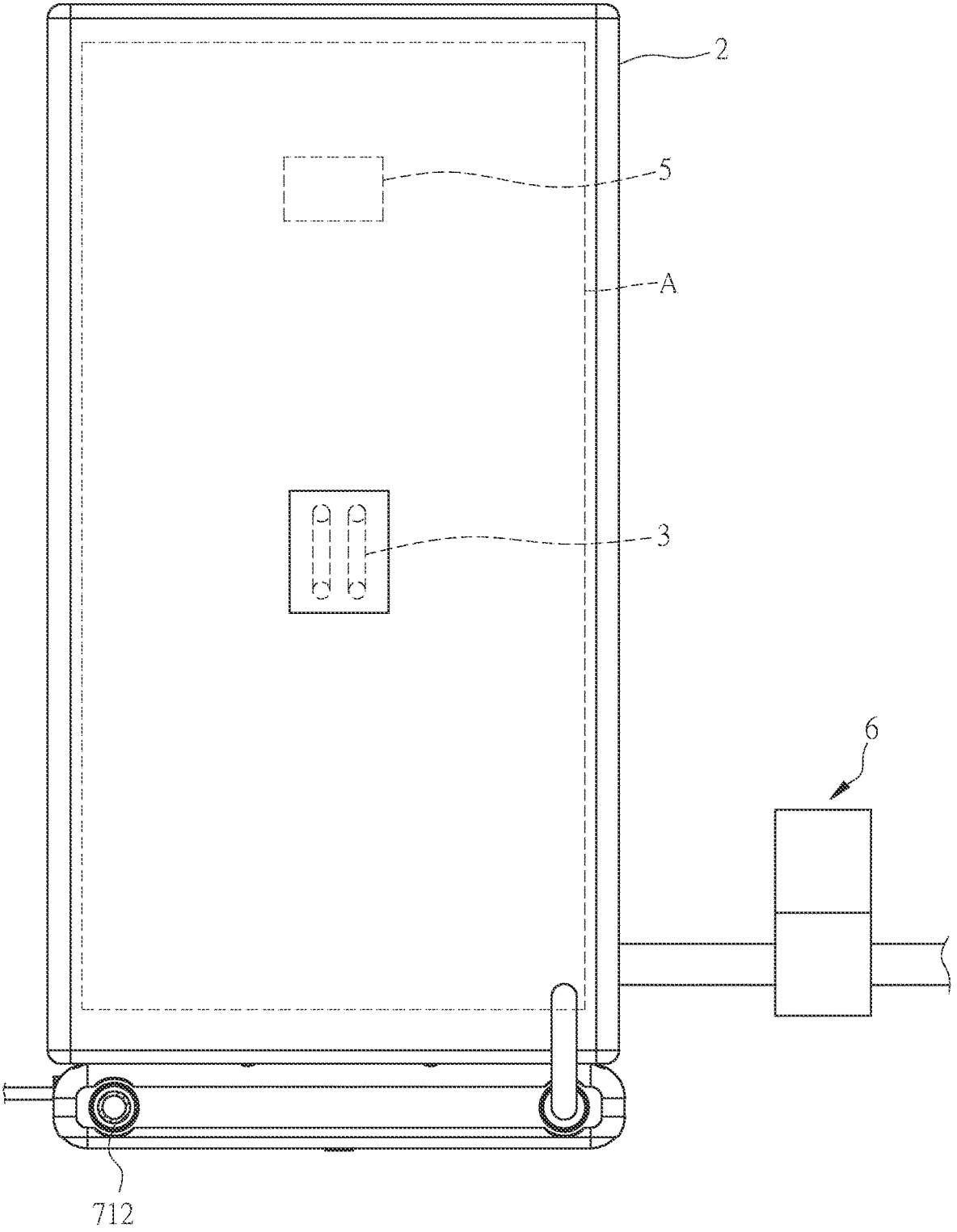
FIG. 9 is a second schematic view according to the preferred embodiment of the present invention, illustrating the full water level.
Figure 10:
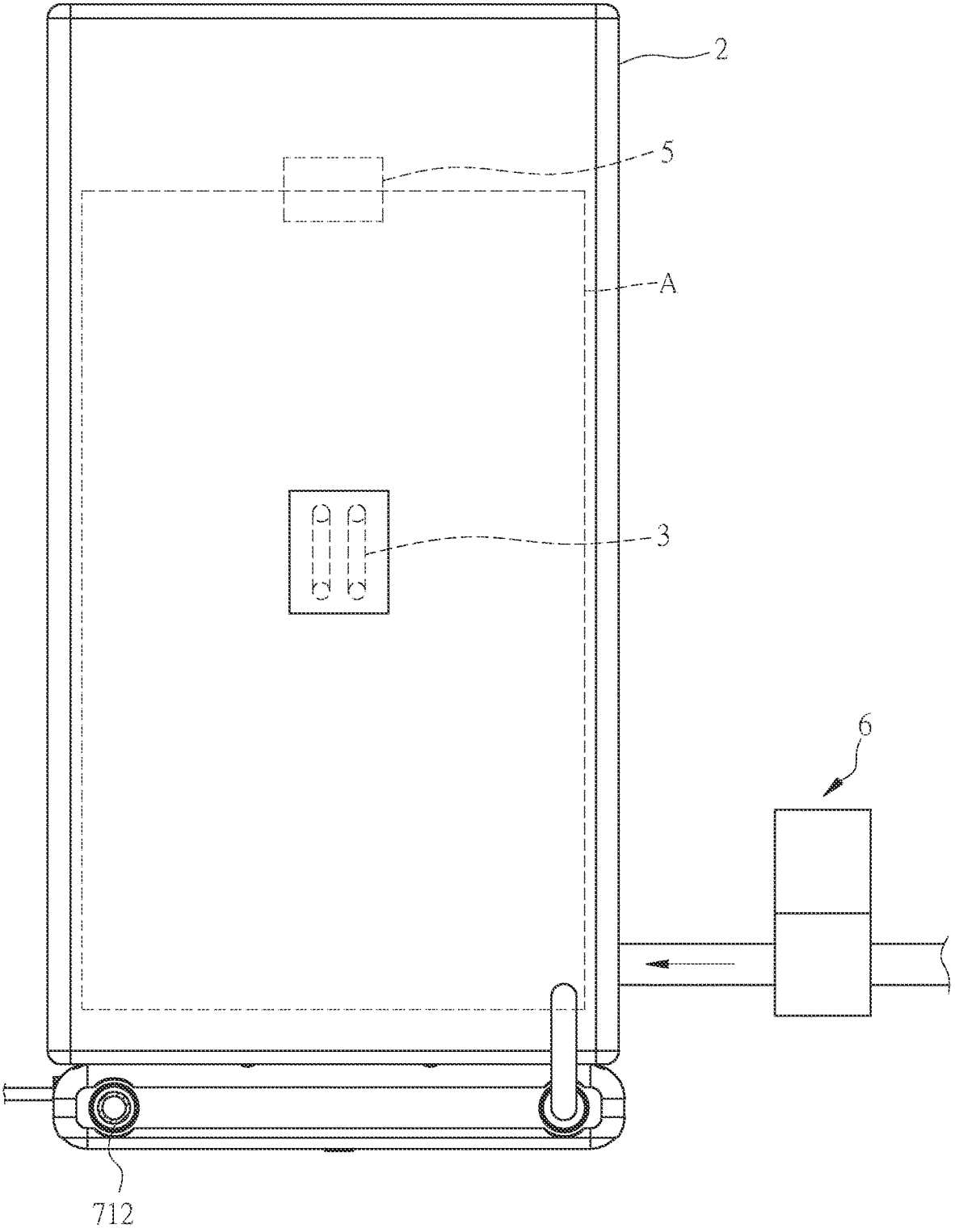
FIG. 10 is a fourth flow diagram according to the preferred embodiment of the present invention, illustrating that the use water is replenished.

Please refer to FIGS. 8-10 in cooperation with FIG. 3. After the use water A flows from the outlet 712 to the water use apparatus, the water level in the storage unit 2 will gradually drop. When the water level detection unit 5 detects that the water level in the storage unit 2 is lower than a threshold, such as 90% of a full water level, the control unit 1 controls the water replenishment unit 6 to replenish the use water A to the storage unit 2.

Please refer to FIGS. 1-3. Since the ambient temperature may affect the heating efficiency, even if the water temperature is known and the corresponding heating power is provided, the water may not be heated to the desired temperature. Therefore, the smart electric heating device of the present invention decides in advance whether to preheat the use water A in the storage unit 2 according to the relatively stable ambient temperature, and adjusts the heating power of the second electric heating rods 72 to ensure that the effluent water temperature reaches the set temperature. This allows users to use hot water of sufficient temperature better in different seasons and regions.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A smart electric heating device, comprising:

a storage unit, stored with water;

a first heating unit, disposed in the storage unit;

a liquid pipe, adjacent to the storage unit, the liquid pipe having an inlet communicating with the storage unit and an outlet opposite to the inlet;

a second heating unit, adjacent to the storage unit and corresponding to the liquid pipe, the second heating unit being configured to heat water in the liquid pipe with a maximum increased temperature;

a control unit, being in signal connection with the first heating unit and the second heating unit; and a first temperature sensing unit, being in signal connection with the control unit, the first temperature sensing unit being disposed outside the storage unit, the first temperature sensing unit being configured to obtain an ambient temperature outside the storage unit;

wherein after the first temperature sensing unit obtains the ambient temperature, the control unit compares the ambient temperature with the maximum increased temperature and a set temperature;

wherein when a difference value between the set temperature and the ambient temperature is greater than the maximum increased temperature, the control unit controls the first heating unit to actuate for heating the water in the storage unit and selectively controls the second heating unit to actuate for heating the water in the liquid pipe, so that an effluent water temperature of the water flowing from the outlet reaches the set temperature;

wherein when the difference value between the set temperature and the ambient temperature is not greater than the maximum increased temperature, the control unit controls the first heating unit not to actuate and selectively controls the second heating unit to actuate for heating the water in the liquid pipe, so that the effluent water temperature of the water flowing from the outlet reaches the set temperature.

2. The smart electric heating device as claimed in claim 1, further comprising a flow sensing unit adjacent to the inlet and corresponding to the liquid pipe, the flow sensing unit being in signal connection with the control unit; wherein when the water in the storage unit flows into the liquid pipe through the inlet and the flow sensing unit obtains that a flow rate change of the water in the liquid pipe is not zero, the control unit controls the first heating unit not to actuate and the second heating unit to actuate.

3. The smart electric heating device as claimed in claim 1, further comprising a plurality of heating sections between the inlet and the outlet, the second heating unit being a plurality of electric heating rods accommodated in the respective heating sections, the control unit including a plurality of control members electrically connected to the respective electric heating rods.

4. The smart electric heating device as claimed in claim 3, further comprising a second temperature sensing unit and a flow sensing unit adjacent to the inlet and corresponding to the liquid pipe, the second temperature sensing unit and the flow sensing unit being in signal connection with the control unit; wherein when the water in the storage unit flows into the liquid pipe through the inlet, the second temperature sensing unit obtains an influent water temperature of the water flowing into the liquid pipe, the flow sensing unit obtains a flow rate change of the water in the liquid pipe, and the control unit controls a heating power of each of the electric heating rods through the respective control members according to a difference value between the set temperature and the influent water temperature as well as the flow rate change.

5. The smart electric heating device as claimed in claim 4, wherein the control members are thyristors, when the control unit controls the heating power of each of the electric heating rods through the respective control members, the heating power of each of the electric heating rods is between 0% and 100% of a maximum heating power, when the heating power of all the electric heating rods is 100% of the maximum heating power, it corresponds to the maximum increased temperature.

6. The smart electric heating device as claimed in claim 1, further comprising a third temperature sensing unit disposed in the storage unit and configured to obtain a storage water temperature in the storage unit, the third temperature sensing unit being in signal connection with the control unit; wherein when a difference value between the set temperature and the storage water temperature is not greater than the maximum increased temperature, the control unit controls the first heating unit not to actuate.

7. The smart electric heating device as claimed in claim 1, further comprising a water level detection unit disposed in the storage unit and a water replenishment unit communicating with the storage unit, the water level detection unit and the water replenishment unit being in signal connection with the control unit; wherein when the water level detection unit detects that a water level in the storage unit is lower than a threshold, the control unit controls the water replenishment unit to replenish water to the storage unit.

8. The smart electric heating device as claimed in claim 1, wherein the liquid pipe is disposed under the storage unit, and the inlet is lower than the storage unit.

9. The smart electric heating device as claimed in claim 1, wherein a sum of the set temperature and the ambient temperature is a fixed value.

10. The smart electric heating device as claimed in claim 1, wherein the first heating unit is an electric heating rod, and the control unit includes a relay electrically connected to the electric heating rod.

* * * * *